US010028585B2

(12) United States Patent
Lee

(10) Patent No.: US 10,028,585 B2
(45) Date of Patent: Jul. 24, 2018

(54) EASEL

(71) Applicant: Jong Moon Lee, Incheon (KR)

(72) Inventor: Jong Moon Lee, Incheon (KR)

(73) Assignee: Jong Moon Lee, Incheon (KR)

( * ) Notice: Subject to any disclaimer, the term of this patent is extended or adjusted under 35 U.S.C. 154(b) by 0 days.

(21) Appl. No.: 15/522,555

(22) PCT Filed: Oct. 2, 2015

(86) PCT No.: PCT/KR2015/010448
§ 371 (c)(1),
(2) Date: Apr. 27, 2017

(87) PCT Pub. No.: WO2016/076535
PCT Pub. Date: May 19, 2016

(65) Prior Publication Data

US 2017/0332786 A1 Nov. 23, 2017

(30) Foreign Application Priority Data

Nov. 14, 2014 (KR) ..... 10-2014-0158693

(51) Int. Cl.
*A47B 97/04* (2006.01)
*A47B 97/08* (2006.01)

(52) U.S. Cl.
CPC ..... *A47B 97/04* (2013.01); *A47B 97/08* (2013.01)

(58) Field of Classification Search
CPC ..... A47B 97/04
USPC ..... 248/460, 447
See application file for complete search history.

(56) References Cited

U.S. PATENT DOCUMENTS 1,842,274 A * 1/1932 Landwehr ..... A47G 1/14 248/460
3,095,834 A * 7/1963 Killen ..... A47B 85/06 108/1
3,759,482 A * 9/1973 Wright ..... A47B 97/08 248/449
3,958,786 A * 5/1976 Mann ..... F16M 13/00 211/195
5,725,192 A * 3/1998 Cloninger ..... A47B 97/04 248/447
5,950,979 A 9/1999 Mira
(Continued)

FOREIGN PATENT DOCUMENTS

KR 20-0244472 Y1 10/2001
KR 10-1231959 B1 2/2013
WO WO 03030686 A1 * 4/2003 ..... A47B 97/04

OTHER PUBLICATIONS

International Search Report for PCT/KR2015/010448.

*Primary Examiner* — Gwendolyn W Baxter
(74) *Attorney, Agent, or Firm* — The PL Law Group, PLLC

(57) ABSTRACT

An easel includes a main frame including a prop in front, a first supporting frame to support the main frame, and a tilting unit. An upper end portion of the first supporting frame is rotatably coupled to the main frame. One end portion of the tilting unit is rotatably coupled to the main frame, the other end portion of the tilting unit is rotatably coupled to the first supporting frame to adjust a tilt angle of the first supporting frame with respect to the main frame and is detachable to be adjustably positioned along a length direction of the first supporting unit. The easel can adjust a tilt angle as desired and reliably maintain an adjusted tilt angle.

6 Claims, 4 Drawing Sheets

(56) References Cited

U.S. PATENT DOCUMENTS

| | | | |
|---|---|---|---|
| 2007/0075209 | A1 | 4/2007 | Kapp |
| 2009/0039229 | A1 | 2/2009 | Barnes |

* cited by examiner

EASEL

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2015/010448, filed on Oct. 2, 2015, which claims priority to the benefit of Korean Patent Application No. 10-2014-0158693 filed in the Korean Intellectual Property Office on Nov. 14, 2014, the entire contents of which are incorporated herein by reference.

BACKGROUND

1. Technical Field

Example embodiments relate to an easel. More particularly, the present inventive relates to an easel allowing for adjustment of a tilt angle as desired and enabling to reliably maintain an adjusted tilt angle.

2. Description of the Related Art

Easels are generally used to hold drawing boards, photographs, pictures, menu blackboards, signboards, or the like to allow many people to view them.

Such easels usually include supporting frames provided on both sides and at a center, a drawing board prop coupled to the front of the supporting frames, and a rear supporting frame coupled to the rear of a central supporting frame among the three supporting frames, by means of a folding member.

Further, in the drawing board prop, after coupling bolts are led into the two supporting frames on both sides and the drawing board prop, coupling nuts are fastened to the coupling bolts.

Thus, the drawing board prop is used after the central supporting frame is lifted or lowered to fit the height of a user and fastened.

However, these general easels have a structure that the rear supporting frame supports the entirety of a load of painting materials including a canvas, or the like held on the drawing board prop with respect to the two supporting frames on both sides.

Thus, the rear supporting frame may fail to tolerate the load of the painting materials, opened with respect to the two supporting frames on both sides, to cause the easel to collapse.

SUMMARY

Some example embodiments provide an easel allowing for adjustment of a tilt angle as desired and enabling to reliably maintain an adjusted tilt angle.

According to example embodiments, an easel may include a main frame including a prop in front; a first supporting frame to support the main frame, an upper end portion of the first supporting frame being rotatably coupled to the main frame; and a tilting unit of which one end portion is rotatably coupled to the main frame, the other end portion of the tilting unit being rotatably coupled to the first supporting frame to adjust a tilt angle of the first supporting frame with respect to the main frame, wherein the other end portion of the tilting unit is detachable to be adjustably positioned along a length direction of the first supporting unit.

In example embodiments, the easel may further include a guide slot formed by penetrating the first supporting unit by a predetermined length along the length direction of the first supporting unit, wherein the other end portion of the tilting unit is positioned within the predetermined length of the guide slot.

In example embodiments, the tilting unit may include a fixing piece coupled to the main frame; a main body piece of which one end portion is rotatably coupled to the fixing piece; and an adjusting piece which is rotatably coupled to the other end portion of the main body piece and which is positionable (i.e., enable to adjust its position) and fixable by moving in contact with the first supporting frame.

In example embodiments, the easel may further include a guide slot formed by penetrating the first supporting frame by a predetermined length along the length direction of the first supporting frame; a stud bolt protruding from the adjusting piece and passing through the guide slot such that an end portion of the stud bolt is exposed; and an adjusting handle screwed onto the end portion of the stud bolt, the adjusting handle being detachable.

In example embodiments, the easel may further include a protective sleeve provided on both sides of the first supporting frame along edge of the guide slot and provided on an inner surface of the guide slot, wherein the protective sleeve is made of a material having a hardness higher than a hardness of the first supporting frame.

In example embodiments, a length of the main body piece may be adjustable such that the fixing piece and the adjusting piece are close to or spaced from each other.

In example embodiments, the easel may further include a protective member provided on both sides of the first supporting frame along edge of the guide slot and provided on an inner surface of the guide slot, wherein the protective member is contact with and faces the adjusting piece.

In example embodiments, the protective member may include a sleeve fixed to the inner surface of the guide slot along the inner surface of the guide slot; a first flange extending along an edge of one end portion of the sleeve, being contact-fixed to one surface of the first supporting frame, and being contacted with the adjusting piece; and a second flange extending along an edge of the other end portion of the sleeve and being contact-fixed to the other surface of the first supporting frame.

In example embodiments, the protective member may further include a first fixing concave and convex portion protruding and recessed in a predetermined pattern on the first flange; and a second fixing concave and convex portion formed on the adjusting piece in a shape corresponding to a shape of the first fixing concave and convex portion, wherein the first flange is in tight contact with the adjusting piece.

Therefore, the easel according to example embodiments may stably disperse and support the load of drawing tools or mounted objects, may adjust the tilt angle freely, and may maintain the adjusted tilt angle reliably by using the tilting unit of which both end portions are rotatably coupled both end portions of the tilting unit to the main frame and the first supporting frame, respectively and which is movable along the length direction of the first supporting frame.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Hereinafter, the present inventive concept will be explained in detail with reference to the accompanying drawings.

Figure 1:
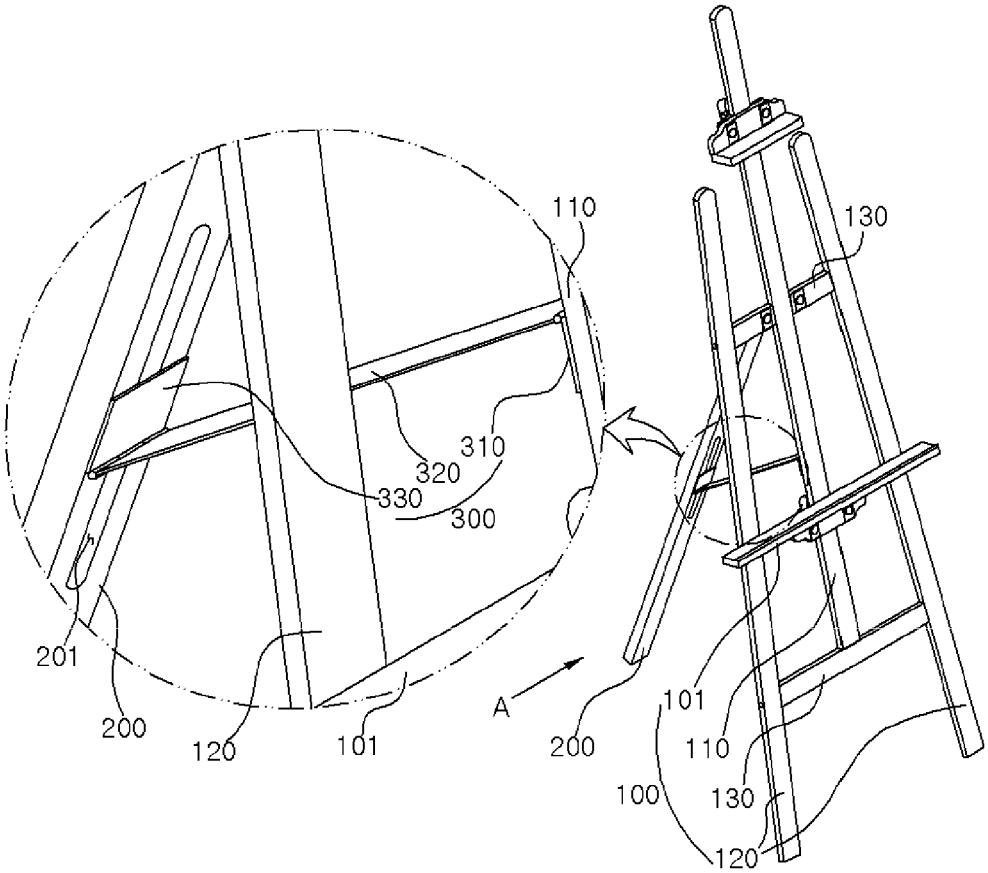
FIG. 1 is a diagram illustrating an overall structure of an easel according to example embodiments and a partially enlarging an appearance of a tilting unit which is a main part of the present invention.

FIG. 1 is a diagram illustrating an overall structure of an easel according to example embodiments and a partially enlarging an appearance of a tilting unit which is a main part of the present invention.

Figure 2:
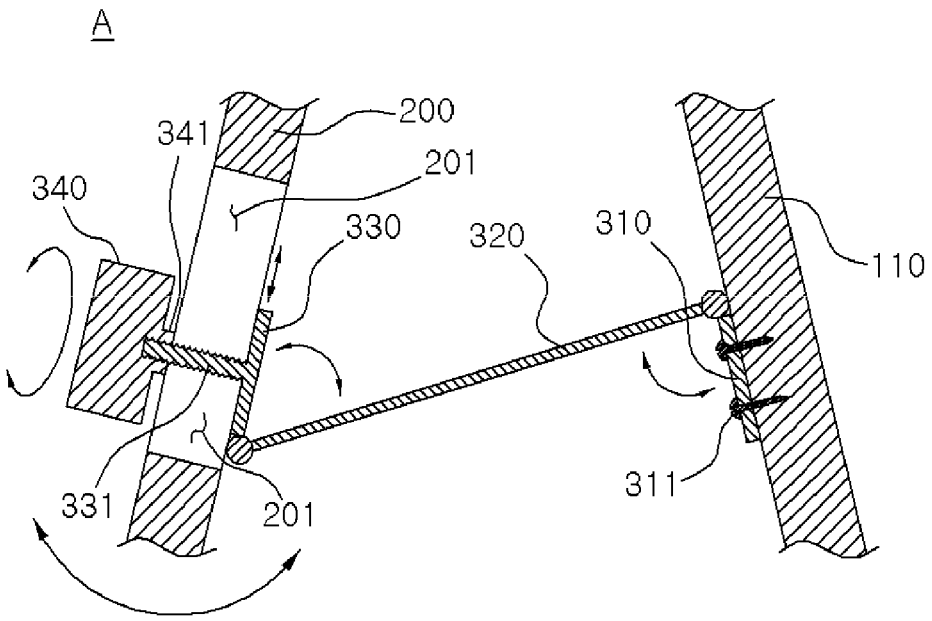
FIG. 2 is a partial cross-sectional conceptual diagram illustrating a structure of the tilting unit coupled to a main frame and a first supporting frame and an operational state as seen from a point A shown in FIG. 1 according to an example embodiment.

FIG. 2 is a partial cross-sectional conceptual diagram illustrating a structure of the tilting unit coupled to a main frame and a first supporting frame and an operational state as seen from a point A shown in FIG. 1 according to an example embodiment.

For reference, unexplained reference numeral 311 in FIG. 2 denotes a fixed member such as a screw or the like.

As illustrated, it can be recognized that the present invention has a structure that a tilting unit 300 is coupled between a main frame 100 and a first supporting frame 200.

The main frame 100 may include a prop 101 in the front, and objects such as photographs, pictures, menus, chalkboards, signs may be mounted on the prop 101.

The first supporting frame 200 may be rotatably coupled to the main frame 100 with an upper end portion thereof. That is, the upper end portion of the first supporting frame 200 may be coupled to the main frame 100, and the first supporting frame 200 may be rotatable with respect to the main frame 100. The first supporting frame 200 may distribute and support loads of the object mounted on the main frame 100 and the prop 101.

One end portion of the tilting unit 300 may be rotatably coupled to the main frame 100, and the other end portion of the tilting unit 300 may be rotatably coupled to the first supporting frame 200 such that a tilting angle of the first supporting frame 200 with respect to the main frame 10 may be adjusted. Here, the other end portion may be detachably coupled such that a position may be adjusted.

The present invention may be applied to the embodiments having above described configurations and embodiments described hereinafter.

Referring to FIG. 1, the main frame 100 may include a central bar 110 and a pair of second supporting frames 120. The central bar 110 may adjust a position of the prop 101 along a length direction (or along a vertical length direction, along a vertical direction). The second supporting frames 120 may be disposed at both sides (i.e., at a left side and a right side) of the central bar 110, and a distance between the supporting frames 120 may be gradually widened toward the bottom such that the second supporting frames 120 may be tilted with a certain angle with respect to the central bar 110.

Therefore, the upper end portion of the first supporting frame 100 may be rotatably coupled to the central bar 110, and one end portion of the tilting unit 300 may be rotatably coupled to the central bar 110.

In addition, the main frame 100 may further include at least one connection bar 130 to improve a structural strength of the main frame 100. The connection bar 130 may be disposed (or may extend) along a length direction of the central bar 110, and both end portions of the connection bar 130 may be coupled to the second supporting frame 120.

The present invention may further include a guide slot 201 which is penetrated with a certain length along a length direction of the first supporting frame 200. Here, the other end portion of the tilting unit 300 may be adjusted within the guide slot 201.

The tilting unit 300 may include a fixed piece 310, a main body piece 120, and an adjusting piece 330. The fixed piece 310 may be coupled to the main frame 100. An end portion of the main body piece 320 may be rotatably coupled to the fixed piece 310. The adjusting piece 330 may move while contacting the first supporting frame 200 to adjust a position thereof and may be fixed.

In an example embodiment, the adjusting piece 330 may include a stud bolt 331 and an adjustable handle 340. The stud bolt 331 may protrude from the adjusting piece 330 and may penetrate the guide slot 201 such that an end portion of the stud bolt 331 may be exposed. The adjustable handle 340 may be screwed onto the end portion of the stud bolt 331 and may be detachable.

Here, the adjustable handle 340 may further include a neck portion 341. The neck portion 341 may protrude toward the adjusting piece , may include threads formed on the inner peripheral surface, and may be coupled with the stud bolt 331. A diameter of the neck portion 341 may be greater than a width of the guide slot 201 such that the adjustable handle 340 may be held in contact with the first supporting frame 200.

Figure 3:
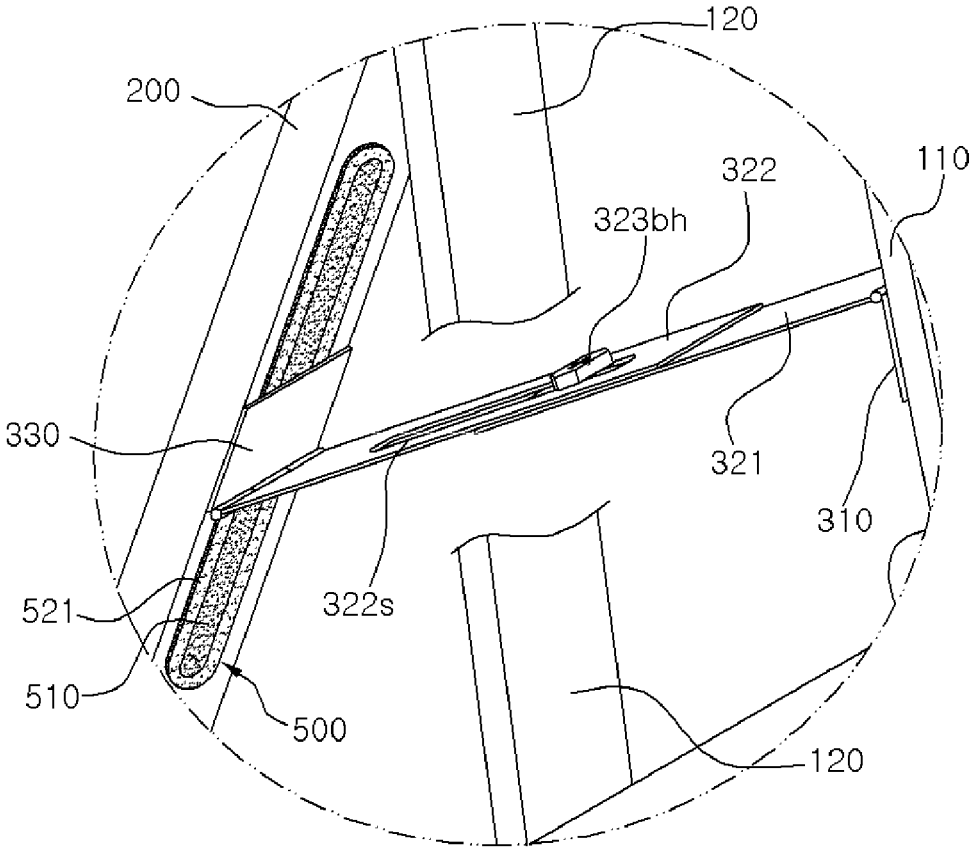
FIG. 3 is a partially enlarged perspective diagram illustrating a structure of the tilting unit coupled to the main frame and the first supporting frame according to another example embodiment.
Figure 4:
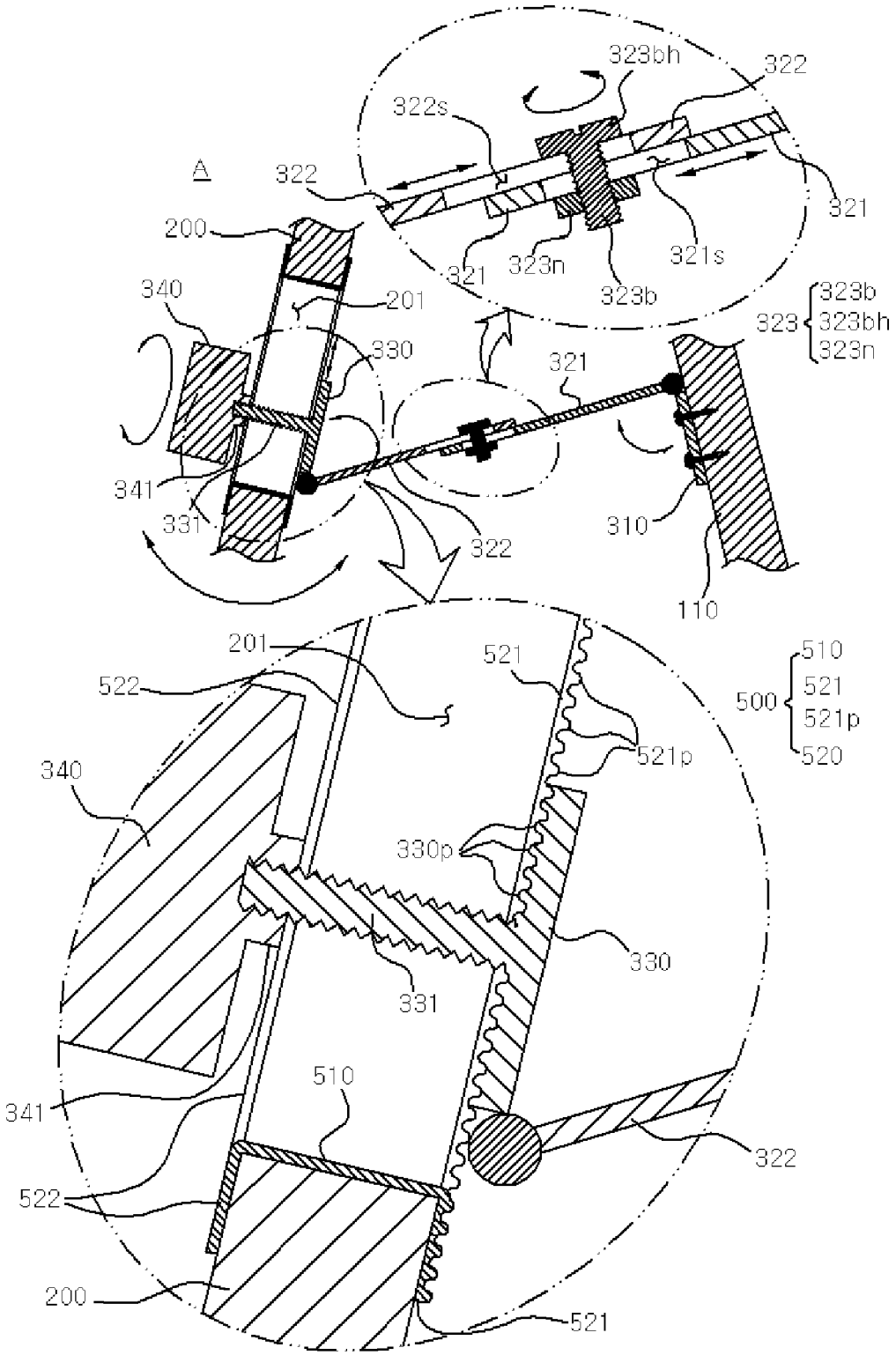
FIG. 4 is a partial cross-sectional conceptual diagram illustrating a structure of the tilting unit coupled to the main frame and the first supporting frame and an operational state as seen from a point A shown in FIG. 1 according to the other example embodiment.

The present invention may further include a protective member 500 as illustrated in FIGS. 3 and 4 to maintain the structural strength of the first supporting frame 200 and to prevent wear.

FIG. 3 is a partially enlarged perspective diagram illustrating a structure of the tilting unit coupled to the main frame and the first supporting frame according to another example embodiment. FIG. 4 is a partial cross-sectional conceptual diagram illustrating a structure of the tilting unit coupled to the main frame and the first supporting frame and an operational state as seen from a point A shown in FIG. 1 according to the other example embodiment.

The protective member 500 may be used in an easel in which the main frame 100 and the first supporting frame 200 are made of wood. The protective member 500 may be provided on both sides of the first supporting frame 200 along edges of the guide slot 201 and at the inner side of the guide slot 201.

Therefore, the protective member 500 may be preferably made of a material having a hardness higher than that of the first support 200 in order to maintain the structural strength of the first supporting frame 200 and in order to prevent wear of the first supporting frame 200 due to repeated position adjustment and fixation of adjusting piece 330.

As illustrated in FIGS. 3 and 4, the main body piece 320 may be configured to be adjustable in length such that the fixing piece 310 and the adjusting piece 330 are closed to or spaced from each other.

That is, the main body piece 320 may be adjustable in length by contact-fixing a first separating piece 321 and a second separating piece 322 by a fastener 323. The first separating piece 321 may be rotatably coupled to the fixing piece 310, and the second separating piece 322 may be rotatably coupled to the adjusting piece 330.

Referring to FIG. 4, the main body piece 320 may further include a first adjusting slot 321*s* and a second adjusting slot 322*s*. The first adjusting slot 321*s* may be penetrated with a certain length along a length direction of the first separating piece 321, and the second adjusting slot 322*s* may be penetrated with a certain length along a length direction of the second separating piece 322. The fastener 323 may contact-fix the first separating piece 321 and the second separating piece 322 by penetrating the first adjusting slot 321*s* and the second adjusting slot 322*s*.

The first adjusting slot 321*s* and the second adjusting slot 322*s* may be arranged in a straight line (or in a same line) to smoothly adjust a length of the main body piece 320 including the first separating piece 321 and the second separating piece 322.

In addition, the fastener 323 may include a bolt 323*b* and a nut 323*n*. A head portion of the bolt 323*b* may be engaged with an upper surface of the second separating piece 322, and the nut 323*n* may be screwed to the bolt 323*b* and fixed to the bottom surface of the first separating piece 321.

Therefore, a user can adjust the length of the main body piece 320 in the following order.

First, the user may cause the bolt 323*b* to pass through the first adjusting slot 321*s* and the second adjusting slot 322*s* at the same time and may temporarily fasten the nut 323*n* to the bolt 323*b*.

Then, in a state in which the nut 323*n* is temporarily fastened to the bolt 323*b*, the user may appropriately move the first separating piece 321 and the and second separating piece 322 in a range of a predetermined length formed by the first adjusting slot 321*s* and the second adjusting slot 322*s* and may fully fasten the nut 323*n* to the bolt 323*b*. Therefore, the user may adjust and maintain the length of the main body piece 320.

The protective member 500 may be brought into contact with and fixed to the adjusting piece 330.

The protective member 500 may include a sleeve 510, a first flange 521, and a second flange 522. The sleeve 510 may be contact-fixed to the inner surface of the guide slot 201 along the inner surface of the guide slot 201. The first flange 521 may extend along one edge of the sleeve 510, may be contact-fixed to one surface of the first supporting frame 200, and may be in contact with the adjusting piece 330. The second flange 522 may extend along the other edge of the sleeve 510 and may be fixed to the other surface of the first supporting frame 200.

Here, the protective member 500 may further include a first fixing concave and convex portion 521*p* and a second fixing concave and convex portion 330*p*. The first fixing concave and convex portion 521*p* may protrude and sink (or be recessed) on the first flange 521 in a predetermined pattern. The second fixing concavo-convex portion 330*p* may be formed on the adjusting piece 330 in a shape corresponding to the first concavo-convex portion 521*p*.

Therefore, the first flange 521 and the adjusting piece 330 may be brought into contact and tightly fixed by the first fixing concavo-convex portion 521*p* and the second fixing concavo-convex portion 330*p* being engaged with each other.

The engagement structure of the first fixing concave and convex portion 521*p* and the second fixing concave and convex portion 330*p* can help prevent the loosening of the fastener 323.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. An easel, comprising:

a main frame including a prop in front;

a first supporting frame to support the main frame, an upper end portion of the first supporting frame being rotatably coupled to the main frame;

a tilting unit of which one end portion is rotatably coupled to the main frame, the other end portion of the tilting unit being rotatably coupled to the first supporting frame to adjust a tilt angle of the first supporting frame with respect to the main frame, wherein the other end portion of the tilting unit is detachable to be adjustably positioned along a length direction of the first supporting unit; and a protective sleeve provided on both sides of the first supporting frame along edge of the guide slot and provided on an inner surface of the guide slot, wherein the protective sleeve is made of a material having a hardness higher than a hardness of the first supporting frame.

2. The easel of claim 1, wherein a length of the main body piece is adjustable such that the fixing piece and the adjusting piece are close to or spaced from each other.

3. The easel of claim 1, wherein a lower end of the adjusting piece is rotatably coupled to the other end portion of the main body piece.

4. An easel comprising:

a main frame including a prop in front;

a first supporting frame to support the main frame, an upper end portion of the first supporting frame being rotatably coupled to the main frame;

a tilting unit of which one end portion is rotatably coupled to the main frame, the other end portion of the tilting unit being rotatably coupled to the first supporting frame to adjust a tilt angle of the first supporting frame with respect to the main frame, wherein the other end portion of the tilting unit is detachable to be adjustably positioned along a length direction of the first supporting unit; and a protective member provided on both sides of the first supporting frame along edge of the guide slot and provided on an inner surface of the guide slot, wherein the protective member is contact with and faces the adjusting piece.

5. The easel of claim 4, wherein the protective member includes:

a sleeve fixed to the inner surface of the guide slot along the inner surface of the guide slot;

a first flange extending along an edge of one end portion of the sleeve, being contact-fixed to one surface of the first supporting frame, and being contacted with the adjusting piece; and a second flange extending along an edge of the other end portion of the sleeve and being contact-fixed to the other surface of the first supporting frame.

6. The easel of claim 5, wherein the protective member further includes:

a first fixing concave and convex portion protruding and recessed in a predetermined pattern on the first flange; and a second fixing concave and convex portion formed on the adjusting piece in a shape corresponding to a shape of the first fixing concave and convex portion, wherein the first flange is in tight contact with the adjusting piece.

* * * * *